United States Patent [19]

Peters

[11] 4,409,095

[45] Oct. 11, 1983

[54] CATALYTIC REFORMING PROCESS

[75] Inventor: Kenneth D. Peters, Elmhurst, Ill.

[73] Assignee: UOP Inc., Des Plaines, Ill.

[21] Appl. No.: 426,017

[22] Filed: Sep. 28, 1982

Related U.S. Application Data

[63] Continuation-in-part of Ser. No. 222,469, Jan. 5, 1981, abandoned.

[51] Int. Cl.[3] ..... C10G 35/04

[52] U.S. Cl. ..... 208/134; 208/64; 208/65

[58] Field of Search ..... 208/64, 65, 79, 80, 208/134, 156, 169; 585/441, 449

[56] References Cited

U.S. PATENT DOCUMENTS

| | | | |
|---|---|---|---|
| 3,566,845 | 3/1971 | Barnes | 122/240 |
| 3,572,296 | 3/1971 | Carson et al. | 122/275 |
| 4,110,197 | 8/1978 | Herning et al. | 208/64 |

*Primary Examiner*—Curtis R. Davis

*Attorney, Agent, or Firm*—James R. Hoatson, Jr.; John F. Spears, Jr.; William H. Page, II

[57] ABSTRACT

A catalytic reforming process is disclosed in which substantially all of the heat requirements of the product stabilizer column is supplied by multiple indirect heat exchange.

5 Claims, 1 Drawing Figure

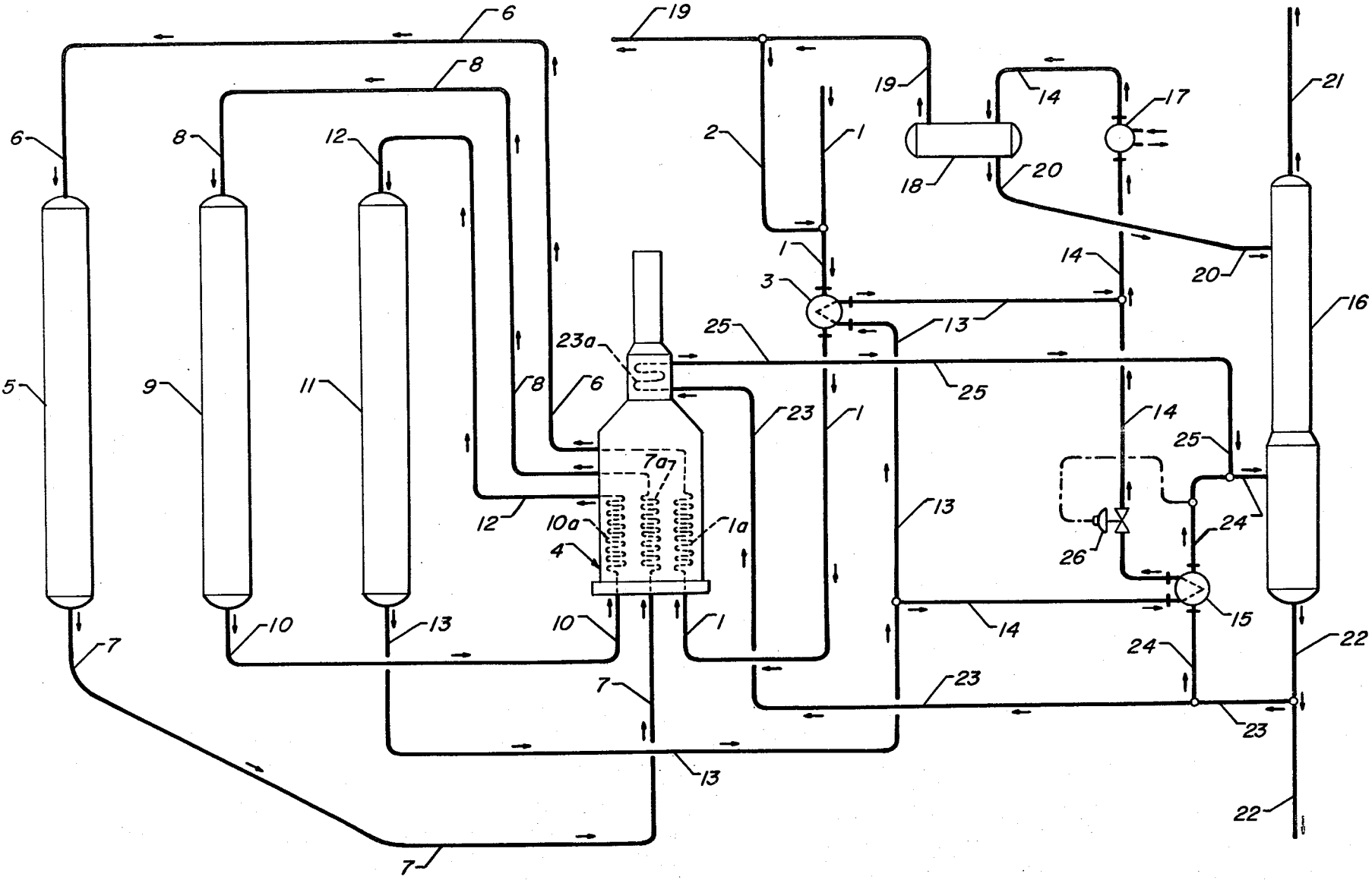
21
16
22
22
20
24
15
23
25
17
14
24
14
26
14
20
13
25
14
18
13
23
19
1
1
3
1
23
2
25
1a
1
19
7a
13
7
23a
6
10a
4
10
8
12
6
8
13
7
12
11
10
8
9
7
6
5

CATALYTIC REFORMING PROCESS

CROSS-REFERENCE TO RELATED APPLICATION

This application is a continuation-in-part of my copending application Ser. No. 222,469 filed Jan. 5, 1981 and now abandoned. All the teachings of said copending application are incorporated herein by specific reference thereto.

The art of catalytic reforming is well known in the petroleum refining industry and does not require detailed description herein. In brief, catalytic reforming art is largely concerned with the treatment of hydrocarbonaceous feedstocks to improve their anti-knock characteristic. Generally the hydrocarbonaceous feedstock comprises a petroleum gasoline fraction. Such a gasoline fraction may be a full boiling range fraction having an initial boiling point of from 50°-100° F. and an end boiling point of from 325°-425° F. More frequently, the gasoline fraction will have an initial boiling point of from 150°-250° F. and an end boiling point of from 350°-425° F., this higher boiling fraction being commonly referred to as naphtha. The reforming process is particularly applicable to the treatment of those straight-run gasolines comprising relatively large concentrations of naphthenic and substantially straight chain paraffinic hydrocarbons which are subject to aromatization through dehydrogenation and/or cyclization reactions. Various other concomitant reactions also occur, such as isomerization and hydrogen transfer, which are beneficial in upgrading the anti-knock properties of the selected gasoline fraction.

As will be hereinafter described in greater detail, in the typical catalytic reforming operation, feedstock, preferably a petroleum gasoline fraction, is first admixed with hydrogen. The feedstock and hydrogen mixture is thereafter heated to reaction temperature and then contacted with reforming catalyst. The reaction effluent is then separated to provide a vapor phase comprising hydrogen at least a portion of which is recycled for admixture with the feedstock and to provide a liquid phase which comprises a hydrocarbon reformate of improved anti-knock characteristics with volatile $C_1$ to $C_4$ components dissolved therein. The liquid phase is then stabilized to remove the volatile $C_1$ to $C_4$ components by fractionation, typically in a debutanizing fractionation column.

As noted above various reactions take place during catalytic reforming. These reactions include dehydrogenation, cyclization, hydrocracking and isomerization. The net result is that catalytic reforming is highly endothermic. It is therefore common practice to effect catalytic reforming in more than one catalyst bed to allow reheating of the reactants in order to assure that they remain at reaction temperature. Thus the reaction effluent from a preceding catalyst bed may be reheated to reaction temperature before passage to a subsequent catalyst bed.

The highly endothermic nature of catalytic reforming necessitates great quantities of heat. Typically heat for catalytic reforming is provided by a fired heater. The hydrocarbon and hydrogen mixture is passed through the radiant heating section of the fired heater where it is heated to reaction temperature. Since only a portion of the total heat liberated in the fired heater is actually absorbed by the hydrocarbon and hydrogen mixture, large quantities of fuel must be combusted in the fired heaters to assure sufficient heat for catalytic reforming.

In order to conserve fuel and reduce the fired heater duty, it has become common practice to recover heat by preheating the feedstock and hydrogen mixture through indirect heat exchange with the reforming reaction effluent. Thus the feedstock and hydrogen mixture is first subjected to indirect heat exchange with the reforming reaction effluent and the preheated mixture is then passed to the fired heater where it is further heated to reaction temperature. Such a preheating step is disclosed in U.S. Pat. No. 4,110,197 and results in fuel savings because of the decrease in fired heater duty.

As noted previously, it is also common practice to subject unstabilized hydrocarbon reformate to a fractionation step following the separation thereof from the hydrogen-containing vapor phase. Typically the fractionation step is effected to remove hydrogen and $C_1$ to $C_4$ hydrocarbons from the unstabilized reformate. Such a fractionation step requires heat input into the fractionation column. Commonly, a source of such heat is a fired heater in which reformate, withdrawn from the column bottom, is heated to a desired temperature and reintroduced into the column. As with the fired heater used to heat the catalytic reforming reactants, the stabilizer column fired heater consumes significant amounts of fuel with only a percentage of the total heat liberated being absorbed by the reformate from the column bottom. It would, therefore, be advantageous to eliminate the stabilizer column fired heater.

As noted previously, only a percentage of the heat liberated in the reforming reactants fired heater is absorbed by the hydrocarbon and hydrogen mixture in the radiant heating section of the heater. The balance of the heat liberated by combustion leaves the radiant section of the heater via high temperature combustion gases. Such hot combustion gases could serve as a source of heat for the stabilizer column by indirect heat exchange with reformate from the reboiler. However, traditional unit operations require that a small fired heater be employed for purposes of controlling the heat input to the column thereby negating part of the advantages to be derived from elimination of the stabilizer column fired heater.

It has now been determined that it is possible to achieve significant fuel savings by utilizing the reforming reactants fired heater as a source of heat for the reformate stabilizer column without having to utilize a second fired heater for control. It is therefore possible to utilize the catalytic reactants fired heater as a source of heat for reformate stabilization and fully realize the advantages to be derived by eliminating the stabilizer column fired heater. Instead of utilizing a small fired heater to control heat input into the column, it has been determined that the reforming reaction effluent can serve as a substitute heat source for purposes of controlling heat input into the stabilizer column. The reforming reaction effluent is subjected to indirect heat exchange with reformate from the bottom of the stabilizer column prior to heat exchanging the reaction effluent with the feedstock and hydrogen mixture. The heated reformate is then returned to the column. Use of the reforming reaction zone effluent as a stabilizer column heat input control source will increase the duty of the reforming reactants fired heater, there being less heat available in the reaction effluent for preheating the feedstock and hydrogen mixture. Notwithstanding the increased reforming reactants fired heater duty, there is still an overall fuel savings compared to the traditional practice of utilizing a separate stabilizer column fired heater without benefit of the reforming reactants fired heater as a heat source for the stabilizer column.

Accordingly it is an object of this invention to achieve a significant reduction in the fuel consumption of a catalytic reforming process by providing essentially all of the heat requirements for the reformate stabilizer column by indirect heat exchange. More specifically, it is an object of this invention to provide essentially all of said heat requirements from indirect heat exchange with the reformate reaction effluent and from the reformate reactants fired heater.

In one of its broad aspects, the present invention embodies a process for catalytic reforming which comprises the steps of: (a) heating a mixture of a hydrocarbonaceous feedstock and hydrogen in a radiant heating section of a fired heater and thereafter contacting the heated mixture with a reforming catalyst at reforming conditions to produce a reaction effluent; (b) subjecting at least a portion of the reaction effluent to a first indirect heat exchange with a portion of a hereinafter specified hydrocarbon reformate; (c) subjecting at least a portion of the reaction effluent to a second indirect heat exchange with said mixture of hydrocarbonaceous feedstock and hydrogen prior to the heating thereof in the fired heater; (d) separating the reaction effluent into a hydrogen-rich vapor phase and a substantially liquid hydrocarbon phase and recycling at least a portion of said hydrogen-rich vapor phase for admixture with said hydrocarbonaceous feedstock; (e) introducing said liquid phase into a stabilizer column, said column being maintained at fractionation conditions sufficient to provide an overhead fraction comprising hydrocarbons normally gaseous at standard temperature and pressure, and a bottom fraction comprising a hydrocarbon reformate; (f) recovering and reheating a first predetermined amount of the hydrocarbon reformate by indirect heat exchange with hot combustion gases in a convection heating section of the fired heater of step (a) and returning the reheated reformate to the stabilizer column to supply a fixed quantity of heat to the column reboiler; (g) recovering a second portion of the hydrocarbon reformate and subjecting it to indirect heat exchange with the reaction effluent as set forth in step (b) and returning the second portion to the stabilizer column to provide the balance of the reboiler heat requirement of the column; and, (h) recovering a third portion of the hydrocarbon reformate as product.

In one preferred embodiment of this invention, said fixed quantity of heat supplied by the first predetermined amount of hydrocarbon reformate is from 50 to 80% of the reboiler heat requirement of the stabilizer column.

In another preferred embodiment of this invention, the quantity of said portion of reaction effluent which is subjected to the first indirect heat exchange with the hydrocarbon reformate is determined in response to a predetermined stabilizer column reboiler temperature.

Other objects and embodiments will become apparent in the following more detailed specification.

The catalytic reforming of petroleum gasoline fractions is a vapor phase operation and is generally effected at conversion conditions which include catalyst bed temperatures in the range of from about 500° to about 1050° F., and preferably from about 600° to about 1000° F. Other reforming conditions include a pressure of from about 50 to about 1000 psig., preferably from about 75 to about 350 psig., and a liquid hourly space velocity (defined as liquid volume of fresh charge per volume of catalyst per hour) of from about 0.2 to about 10 $hr^{-1}$. The reforming reaction is carried out generally in the presence of sufficient hydrogen to provide a hydrogen/hydrocarbon mole ratio of from about 0.5:1.0 to about 10.0:1.0.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor or the catalyst bed may be enclosed in a separate reactor in a side-by-side reactor arrangement. The reaction zones will generally comprise two to four catalyst beds in either the stacked or side-by-side configuration. In any case, as noted previously the endothermic nature of catalytic reforming requires the heating of both fresh charge stock and catalyst bed effluents before the introduction thereof to subsequent catalyst beds. The amount of catalyst used in each of the catalyst beds may be varied to compensate for the endothermic nature of the reforming reaction. For example, three catalyst beds are used to illustrate one preferred embodiment of this invention with about 12 vol.% being employed in the first bed and about 44 vol.% in each of the succeeding beds. Generally, the first bed will contain from about 10 to about 30 vol.%, the second from about 25 to about 45 vol.%, and the third from about 40 to about 60 vol.%. With respect to a four-catalyst bed system, suitable catalyst loadings would be from about 5 to about 15 vol.% in the first bed, from about 15 to about 25 vol.% in the second, from about 25 to about 35 vol.% in the third, and from about 35 to about 50 vol.% in the fourth. Unequal catalyst distribution, increasing in the serial direction of reactant stream flow, facilitates and enhances the distribution of the reactions as well as the overall heat of reaction.

Reforming catalytic composites known and described in the art are intended for use in the process encompassed by the present invention. As noted previously, catalytic reforming reactions are multifarious and include dehydrogenation of naphthenes to aromatics, the dehydrocyclization of paraffins to aromatics, the hydrocracking of long-chain paraffins into lower boiling normally liquid material and, to a certain extent, the isomerization of paraffins. These reactions are generally effected through utilization of catalysts comprising one or more Group VIII noble metals (e.g. platinum, osmium, iridium, rhodium, ruthenium, palladium) combined with a halogen (e.g. chlorine and/or fluorine) and a porous carrier material such as alumina. Recent investigations have indicated that additional advantageous results are attainable and enjoyed through the cojoint use of a catalytic modifier; these are generally selected from the group of iron, cobalt, copper, nickel, gallium, zinc, germanium, tin, cadmium, rhenium, bismuth, vanadium, alkali and alkaline-earth metals, and mixtures thereof.

As noted earlier, the reforming operation further includes the separation of the hydrogen-rich vapor phase from the reaction effluent recovered from the reaction zone, at least a portion of which is recycled to the reaction zone. This separation is usually effected at substantially the same pressure as employed in the reaction zone, allowing for pressure drop in the system, and at a temperature in the range of about 60° to about 120°

F. to yield a vapor phase comprising relatively pure hydrogen. The principally liquid hydrocarbon phase is further treated in a product stabilizer column for the recovery of the reformed product which is commonly referred to as reformate.

The reformate product stabilizer is operated at conditions selected to separate a normally gaseous hydrogen fraction generally comprising $C_4$−hydrocarbons or, if desired, $C_5$−hydrocarbons, and usually some residual hydrogen. Operating conditions typically include a pressure of from about 100 to about 300 psig., the pressure generally being less than that at which the hydrogen-rich vapor phase is separated from reaction effluent to avoid the necessity of pumping the liquid hydrocarbon phase into the stabilizer column. Other operating conditions within the column include a bottoms temperature of from about 400° to about 500° F., and a top temperature of from about 110° to about 200° F. In the past a major portion of the heat requirement of the stabilizer column was generally provided by a separate fired heater. However, in contrast to past practice, the present invention utilizes the reforming reactants fired heater as a source of heat for the stabilizer column without use of a separate fired heater.

Fired heaters which may be employed in the present invention are those commonly used in the petroleum and chemical industries. They may be gas or oil fired. Fired heaters of the box or rectangular from may be used as well as the center-wall updraft type. Such heaters incorporate a radiant heat section comprising one or more banks of tubes, carrying the process fluid, along the different wall surfaces positioned in a manner to receive radiant heat from the burners. It the center-wall configuration, the radiant heat section comprises a row of burners which fire against each side of a longitudinal center partitioning wall and the resulting radiant heat is supplied to the process fluid tubes positioned along each sidewall. As an alternative to the traditional tube banks, it is also possible to employ inverted U-tube sections such as those disclosed in U.S. Pat. No. 3,566,845. A preferred process fluid tube configuration and heater design is set forth in U.S. Pat. No. 3,572,296 which discloses a low pressure drop heater particularly well suited for application in catalytic reforming operations.

Regardless of the configuration of the radiant heating section, not all the heat liberated by the firing of the fuel is absorbed by the process fluid in the radiant heating section. Rather, a substantial amount of heat leaves the radiant heating section with the combustion gases. It has become the practice to recover this heat from the hot combustion gases in the fired heater convection heating section. As with the radiant heat sections, convection heat sections may have various configurations. They may be designed to allow uniform flow of combustion gases through the convection heating section. Alternatively nonuniform flow of combustion gases may be employed by varying the symmetry of the combustion gas flow path. Irrespective of its exact configuration, the convection section is arranged to allow the hot combustion gases to contact process fluid tubes, thereby effecting convective heat transfer between the gases and the tubes.

Of course the foregoing discussion on fired heaters is intended as a general explanation and is not meant to be an undue limitation on the scope of the present invention.

ILLUSTRATIVE EMBODIMENT

Further description of the process of this invention is presented with reference to the attached schematic drawing. The drawing and accompanying description represent a preferred illustrative embodiment of the invention. The data in the description are based on detailed calculations made for the purpose of design. The following illustrative embodiment is not intended as an undue limitation on the generally broad scope of the invention as set out in the appended claims. Miscellaneous hardware, such as certain pumps, compressors, heat exchangers, valves, instrumentation and controls have been omitted or reduced in number as not essential to a clear understanding of the process, the utilization of such hardware being well within the purview of one skilled in the art.

Referring then to the drawing, a petroleum-derived naphtha fraction is charged to the process at a rate of about 529.8 moles per hour for a liquid hourly space velocity of about 3 $hr.^{-1}$ by way of line 1. It is then admixed with about 3336.2 moles per hour of a hydrogen-rich gaseous stream, originating as hereinafter described, comprising about 71 mol.% hydrogen introduced from line 2 for a hydrogen to hydrocarbon ratio of about 4.5. The fresh feed is continued through heat exchanger 3 in line 1 wherein it is preheated to about 879° F. by indirect heat exchange with an effluent stream in line 13 recovered from reactor 11. The preheated reaction mixture is continued through line 1 to a gas-fired heater 4 and passed through a charge heating coil 1*a* in the radiant heating section thereof to provide a temperature of about 990° F. at the inlet to the catalyst bed of reactor 5. Reactor 5 is the first of three reactors comprising the catalytic reforming reaction zone, each of said reactors being maintained at reforming conditions including a temperature of about 990° F. and a pressure of about 325 psig. Said reforming conditions further include the utilization of a platinum-containing catalyst. The heated reaction mixture is transferred from said heater 4 to the initial reactor 5 via line 6.

Since the catalytic reforming reaction is endothermic in nature, the effluent stream from reactor 5 is directed through line 7 to another heating coil 7*a* in the radiant heating section of the fired heater 4 wherein said effluent stream is reheated to provide a temperature of about 990° F. at the inlet to the catalyst bed of reactor 9. The reheated reactor 5 effluent stream is withdrawn from the heater 4 and introduced into the second reactor 9 by way of line 8.

The effluent from reactor 9 is recovered through line 10 and passed to still another heating coil 10*a* in the radiant heating section of the fired heater 4 to be reheated before introduction into the last reactor 11 of the series of reactors which comprise the catalytic reaction zone, the reheated effluent being withdrawn from said heater and introduced into said reactor 11 by way of line 12. The effluent stream from the last reactor 11 is withdrawn through line 13 at a temperature of about 970° F. and at a rate of about 4540.5 moles per hour. Approximately 183.7 moles per hour of the last mentioned effluent stream is diverted from line 13 into line 14, and this diverted stream is passed through heat exchanger 15 associated with stabilizer column 16. The diverted effluent stream is utilized in said exchanger 15 to effect indirect heat exchange with a portion of the reformate product recovered from the stabilizer column 16 and recycled thereto by way of line 24. The amount of reactor 11 effluent that is diverted to exchanger 15 is controlled by control valve 26 in a manner hereinafter related. From the exchanger 15, the diverted effluent stream continues through line 14 to be recombined with the main portion of the reactor 11 effluent stream from line 13, this main portion, about 4356.8 moles per hour, having been routed through heat exchanger 3 to preheat the fresh feed passing through line 1 as heretofore mentioned. The recombined reactor 11 effluent stream is passed through cooler 17 contained in line 14 and deposited into a separator 18 at a temperature of about 100° F. The separator 18 is maintained at conditions to separate a hydrogen-rich gaseous phase and a substantially liquid hydrocarbon phase, said conditions including a temperature of about 100° F. and a pressure of about 305 psig. The hydrogen-rich gaseous phase, comprising about 71 mol.% hydrogen, is recovered through an overhead line 19 with one portion, about 3336.2 moles per hour, being diverted through line 2 and admixed with the aforementioned naphtha fraction charged to the process through line 1. The balance of the gaseous phase from the separator 18 is discharged from the process through line 19 at a rate of about 583 moles per hour.

The substantially liquid hydrocarbon phase is withdrawn from the separator 18 by way of line 20 and introduced into the stabilizer column 16 which is maintained at conditions of temperature and pressure to separate an overhead fraction comprising normally gaseous hydrocarbons, i.e. $C_4$−hydrocarbons. This overhead fraction is withdrawn from the stabilizer column through line 21 at a rate approximating 122 moles per hour. The reformate product is withdrawn as a bottoms fraction from the stabilizer column 16 via line 22 at a rate of about 1322.3 moles per hour at a temperature of about 459° F. Approximately 820.8 moles per hour of the reformate product stream is diverted into line 23 with a predetermined amount, about 75%, of said stream being passed through line 23 and processed through heating coil **23*a* in the convection heating section of the fired heater 4 in indirect heat exchange with the hot combustion gases passing therethrough. In this case, the predetermined amount is selected to provide about 75% of the reboiler heat requirement of the stabilizer column. The predetermined amount may be controlled by any conventional means such as a pump or flow controller. The reformate product stream, after heating in the convection heating section, is returned to the stabilizer column via lines 25 and 24** at a temperature of about 503° F.

About 25% of the reformate product stream diverted into line 23 is recycled to the stabilizer column 16 via line 24 and through exchanger 15. In heat exchanger 15, the thus-recycled stream is heated to about 503° F. to provide the balance of the reboiler heat requirements of the stabilizer column, about 25% in this case. The recycle stream is heated in exchanger 15 by indirect heat exchange with reactor 11 effluent passing through line 14. As previously mentioned, the flow of a reactor 11 effluent diverted to exchanger 15 is controlled by control valve 26. Control valve 26 operates, through appropriate instrumentation, in response to the reboiler temperature of the stabilizer column. A predetermined reboiler temperature is selected to provide the desired overhead and bottoms product quality. A predetermined amount of the reboiler heat requirement to be obtained from the fired heater convection heating section is determined. Control valve 26 in turn operates to divert from line 13 sufficient quantities of reactor 11 effluent to exchanger 15 to provide the remainder of the heat necessary to obtain the predetermined stabilizer reboiler temperature. Control valve 26 further operates to maintain the predetermined reboiler temperature by varying the flow of reactor 11 effluent to exchanger 15 as necessary.

A comparison of the fired heater fuel consumption of the invention as described in the illustrative embodiment set out above with that of one prior art reforming process clearly exemplifies the advantages to be achieved by use of the invention. For purposes of the comparison such a prior art reforming process, having two separate fired heaters and a charge rate equal to that of the illustrative embodiment, would have a reforming reactants fired heater duty of about $23.7\times10^6$ BTU/hr. and a stabilizer reboiler fired heater duty of about $5.8\times10^6$ BTU/hr. An all radiant reforming reactants fired heater, not employing a convection heating section, typically has a heater efficiency of about 54% based on the lower heating value of the fuel. Accordingly the reforming reactants fired heater would necessarily need to fire about $43.9\times10^6$ BTU/hr. to achieve a heater duty of $23.7\times10^6$ BTU/hr. A stabilizer reboiler fired heater would typically have a heater efficiency of about 84.5% based on a 100° F. approach temperature with the heater flue gas and the lower heating value of the fuel. This would necessitate that about $6.8\times10^6$ BTU/hr. of fuel be fired to achieve the stabilizer reboiler fired heater duty. The overall prior art process then would require $43.9\times10^6$ BTU/hr. $+6.8\times10^6$ BTU/hr. or $50.7\times10^6$ BTU/hr. of fuel fired which results in an overall fuel efficiency of:

$$\frac{23.7\times10^6\ \text{BTU/hr.}+5.8\times10^6\ \text{BTU/hr.}}{50.7\times10^6\ \text{BTU/hr.}}\ \text{or } 58.1\%$$

In contrast a catalytic reforming process in accordance with the illustrative embodiment of the invention has a reforming reactants fired heater duty of about $25.0\times10^6$ BTU/hr. It should be noted that this heater duty is larger than the corresponding heater duty of the prior art. This results from the fact that, in accordance with the invention, a portion of the reactor 11 effluent heat is utilized to reboil the stabilizer and consequently is not available to preheat the fresh feed. In the prior art process, all of the reactor effluent is available for preheat of the reactor feed and therefore the feed enters the reforming reactants fired heater at a higher inlet temperature, reducing the fired heater duty. Since the $25\times10^6$ BTU/hr. heater duty in the fired heater of the illustrative embodiment is essentially picked up in the radiant heating section, the heater efficiency would be about 54% as before. Thus the amount of fuel fired to achieve the heater duty is $46.2\times10^6$ BTU/hr. In addition about 75% of the stabilizer reboiler duty or about $4.3\times10^6$ BTU/hr. is picked up in the convection heating section of the fired heater. However, this heat comes from the hot combustion gases rather than by firing additional fuel. Therefore, the invention results in an overall fuel efficiency of:

$$\frac{25.0\times10^6\ \text{BTU/hr.}+4.3\times10^6\ \text{BTU/hr.}}{46.2\times10^6\ \text{BTU/hr.}}\ \text{or about } 63.2\%$$

It is important to note that the invention results in increased efficiency even though the reforming reactants fired heater has a greater duty than the corresponding heater in the prior art process. This is because reactor 11 effluent is utilized to provide part of the heat requirements for the stabilizer and is not available to preheat the feed mixture. Accordingly the reforming reactants fired heater duty is increased to compensate for the lower level of feed preheat. For this reason, it would not be readily apparent that utilizing the reactor effluent and convection heating section to reboil the stabilizer would lead to an increase in fuel efficiency. Especially since heater duty is in effect being shifted from the higher efficiency prior art stabilizer reboiler fired heater to the less efficient radiant heating section of the reforming reactants fired heater in the invention, it would not be expected that shifting heater duty from a more efficient heater to a less efficient heater would lead to the overall increase in fuel efficiency achieved by the invention.

Of course it is apparent to those of ordinary skill in the art that various reactor effluent heat exchange flow patterns may be utilized in the invention although not with equal results. In the embodiment depicted in the drawing, the portion of the reaction effluent which is subjected to the first indirect heat exchange with the reformate is a different portion than the portion of the reaction effluent which is subjected to the second indirect heat exchange with the mixture of hydrocarbonaceous feedstock and hydrogen. Alternatively the reactor effluent heat exchange flow pattern may be arranged so that the portion of the reaction effluent which is subjected to the second indirect heat exchange with the hydrocarbonaceous feedstock and hydrogen includes at least part of the portion of the reaction effluent previously subjected to the first indirect heat exchange with the reformate.

I claim as my invention:

1. A catalytic reforming process comprising the steps of:

(a) heating a mixture of a hydrocarbonaceous feedstock and hydrogen in a radiant heating section of a fired heater and thereafter contacting the heated mixture with a reforming catalyst at reforming conditions to produce a reaction effluent;

(b) subjecting at least a portion of the reaction effluent to a first indirect heat exchange with a portion of a hereinafter specified hydrocarbon reformate;

(c) subjecting at least a portion of the reaction effluent to a second indirect heat exchange with said mixture of hydrocarbonaceous feedstock and hydrogen prior to the heating thereof in the fired heater;

(d) separating the reaction effluent into a hydrogen-rich vapor phase and a substantially liquid hydrocarbon phase and recycling at least a portion of said hydrogen-rich vapor phase for admixture with said hydrocarbonaceous feedstock;

(e) introducing said liquid phase into a stabilizer column, said column being maintained at fractionation conditions sufficient to provide an overhead fraction comprising hydrocarbons normally gaseous at standard temperature and pressure, and a bottom fraction comprising a hydrocarbon reformate;

(f) recovering and reheating a first predetermined amount of the hydrocarbon reformate by indirect heat exchange with hot combustion gases in a convection heating section of the fired heater of step (a) and returning the reheated reformate to the stabilizer column to supply a fixed quantity of heat to the column reboiler;

(g) recovering a second portion of the hydrocarbon reformate and subjecting it to indirect heat exchange with the reaction effluent as set forth in step (b) and returning the second portion to the stabilizer column to provide the balance of the reboiler heat requirement of the column; and, (h) recovering a third portion of the hydrocarbon reformate as product.

2. The process of claim 1 further characterized in that said fixed quantity of heat supplied by the first predetermined amount of hydrocarbon reformate is from 50 to 80% of the reboiler heat requirement of the stabilizer column.

3. The process of claim 1 or 2 wherein the quantity of said portion of reaction effluent which is subjected to the first indirect heat exchange with the hydrocarbon reformate is determined in response to a predetermined stabilizer column reboiler temperature.

4. The process of claim 1 wherein the portion of the reaction effluent which is subjected to the first indirect heat exchange with the reformate is a different portion than the portion of the reaction effluent which is subjected to the second indirect heat exchange with the mixture of hydrocarbonaceous feedstock and hydrogen.

5. The process of claim 1 wherein the portion of the reaction effluent which is subjected to the second indirect heat exchange with the hydrocarbonaceous feedstock and hydrogen includes at least part of the portion of the reaction effluent previously subjected to the first indirect heat exchange with the reformate.

* * * * *